United States Patent [19]

Platte, Sr.

[11] Patent Number: 4,969,922

[45] Date of Patent: Nov. 13, 1990

[54] RIBBED BOTTLE WITH DEPRESSED OBLONG CENTERS

[75] Inventor: Richard L. Platte, Sr., Ann Arbor, Mich.

[73] Assignee: Ann Arbor International, Inc., Ann Arbor, Mich.

[21] Appl. No.: 336,228

[22] Filed: Apr. 11, 1989

Related U.S. Application Data

[63] Continuation-in-part of Ser. No. 171,302, Mar. 21, 1988.

[51] Int. Cl.[5] ..... B65D 1/42; B65D 23/10

[52] U.S. Cl. ..... 215/1 C; 220/673

[58] Field of Search ..... D9/376, 379, 39, 406; 215/1 C, 10, 1 R; 220/72

[56] References Cited

U.S. PATENT DOCUMENTS

| | | | |
|---|---|---|---|
| D. 190,528 | 6/1961 | Brandeis | D9/406 |
| D. 203,229 | 12/1965 | Szajna | D9/406 |
| 4,274,548 | 6/1981 | Schneider | 220/72 |
| 4,609,106 | 9/1986 | Gentilli | 220/72 X |
| 4,733,804 | 3/1988 | Slat et al. | 220/72 X |

FOREIGN PATENT DOCUMENTS

| | | | |
|---|---|---|---|
| 2049989 | 4/1972 | Fed. Rep. of Germany | 220/72 |
| 2115507 | 10/1972 | Fed. Rep. of Germany | 220/72 |
| 2723515 | 11/1978 | Fed. Rep. of Germany | 220/72 |
| 2732881 | 2/1979 | Fed. Rep. of Germany | 220/72 |

*Primary Examiner*—Sue A. Weaver

*Attorney, Agent, or Firm*—James M. Deimen

[57] ABSTRACT

A blow molded bottle comprising oblong depressions in opposed major sides of the bottle, the bottom of the oblong depressions being joined at the center of the bottle. Extending from the major axes ends of the oblong depressions is a single depressed rib circumferentially extending about the bottle. The joined oblong depressions and circumferential rib substantially increase the rigidity of the major sides of the bottle allowing a substantial decrease in bottle wall thickness and attendant material weight.

11 Claims, 3 Drawing Sheets

RIBBED BOTTLE WITH DEPRESSED OBLONG CENTERS

This is a continuation-in-part of copending application(s) Ser. No. 07/171,302 filed on 3/21/88.

BACKGROUND OF THE INVENTION

The field of the invention pertains to the manufacture and configuration of bottles, in particular, thin walled plastic bottles.

Bottles manufactured of flexible plastics with thin wall thickness generally rely upon the curvature of the bottle shape to provide the necessary rigidity to the bottle. A flat sided bottle, however, must rely upon the inherent rigidity of the plastic material and sufficient wall thickness to prevent excessive bowing out distortion of the flat sides when the bottle is filled to capacity.

In a currently pending U.S. design patent application by the inventor, Ser. No. 06/903,102, a circular central depression in each major side of the bottle is bonded together at the bottle center and a depressed midriff rib circumferentially extends about the bottle at the circular depression. This configuration has been found to stiffen the major flat sides of the bottle, in particular, water bottles of two to four gallon capacity. The solid circular bonded depressions of this design without a hole there through have been found superior in rigidity to a bottle with a circular hole there through.

However, improvements to further stiffen by configuration and thereby allow a decrease in wall thickness and bottle weight are a desirable goal.

SUMMARY OF THE INVENTION

The invention comprises improvements in substantially flat sided bottles to further reduce the bowing out distortion of the flat sides of the bottles when filled. Oblong depressions extending to the center of a bottle from the opposed major sides are joined in the blow molding process of manufacturing the bottle. The oblong depressions are preferably located at the centers of the opposed sides and oriented with the major axes of the depressions parallel to the major length of the opposed sides. A depressed rib extends from the major axes ends of the oblong depressions circumferentially about the bottle.

The combined center joined oblong depressions and major length circumferential depressed rib suprisingly increase the rigidity of the major side of the bottle in comparison with the midriff rib and circular depressions noted above. As a result a substantial decrease in bottle wall thickness and bottle material weight is possible. A lighter, more economical bottle results with great savings in typical production runs of hundreds of thousands of bottles.

DESCRIPTION OF THE PREFERRED EMBODIMENT

Figure 1:
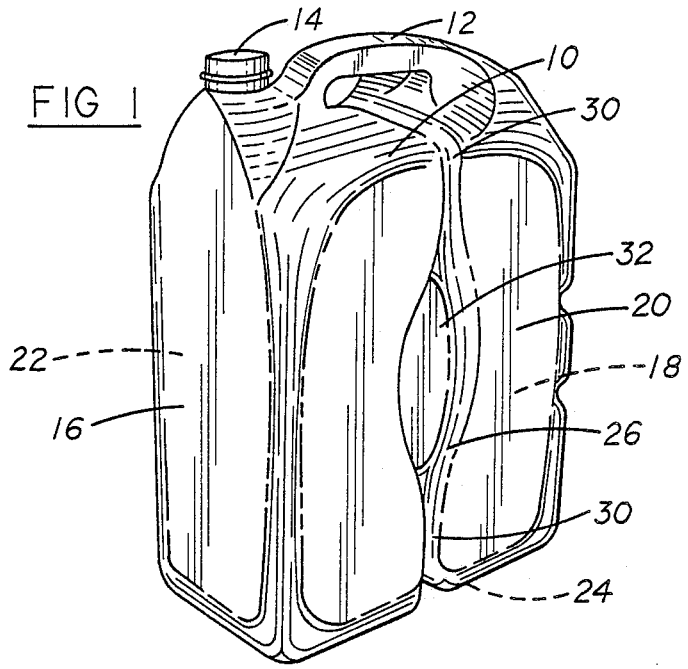
FIG. 1 is a perspective view of the improved bottle.
Figure 2:
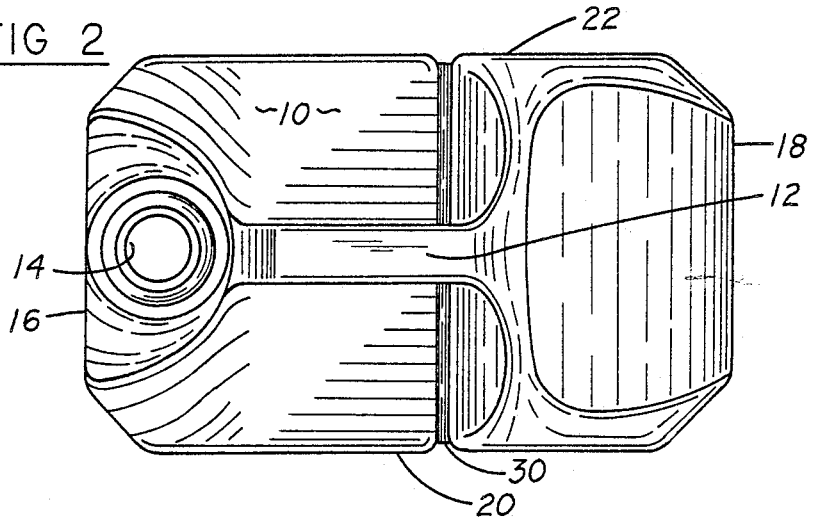
FIGS. 2 through 7 are top, bottom, right side, front, back and left side views respectively of the new bottle.
Figure 3:
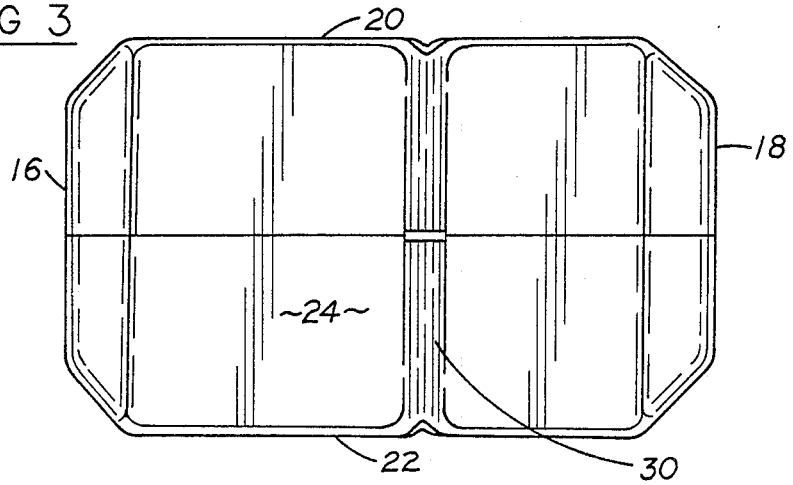
Figure 4:
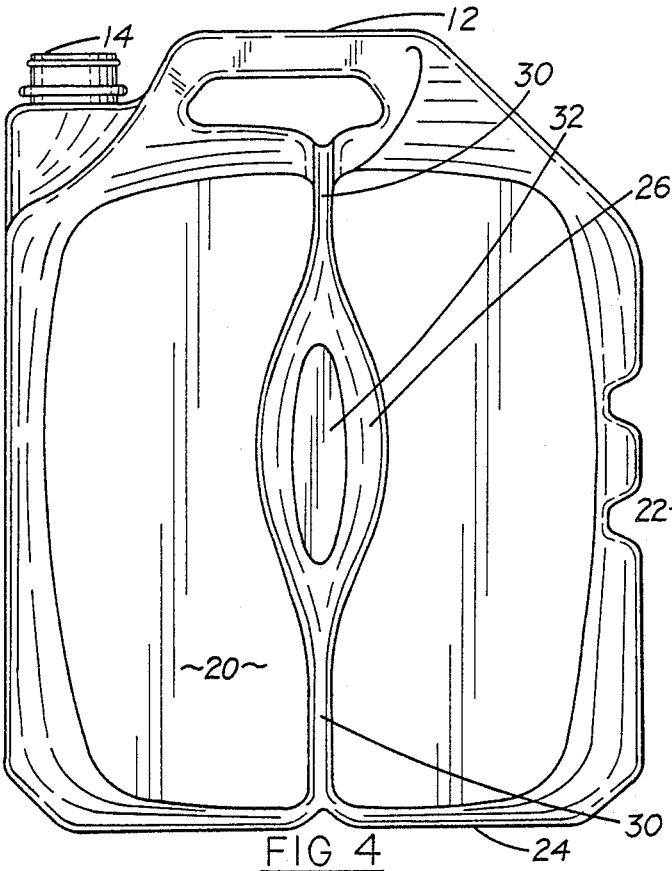
Figure 5:
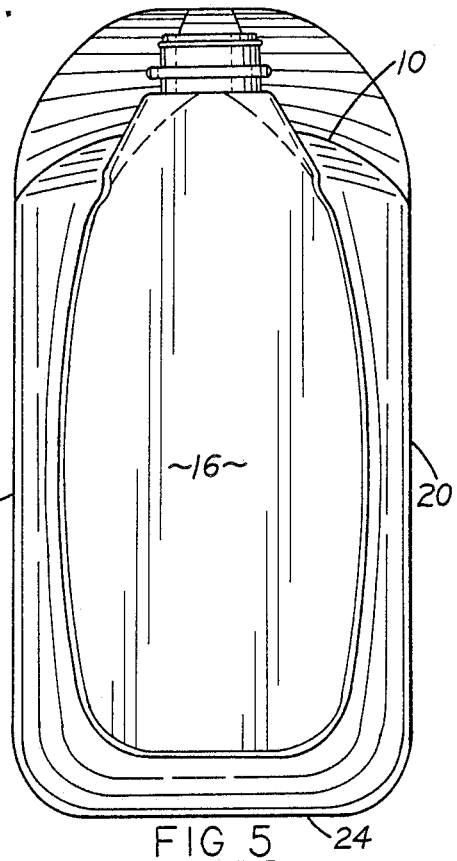
Figure 6:
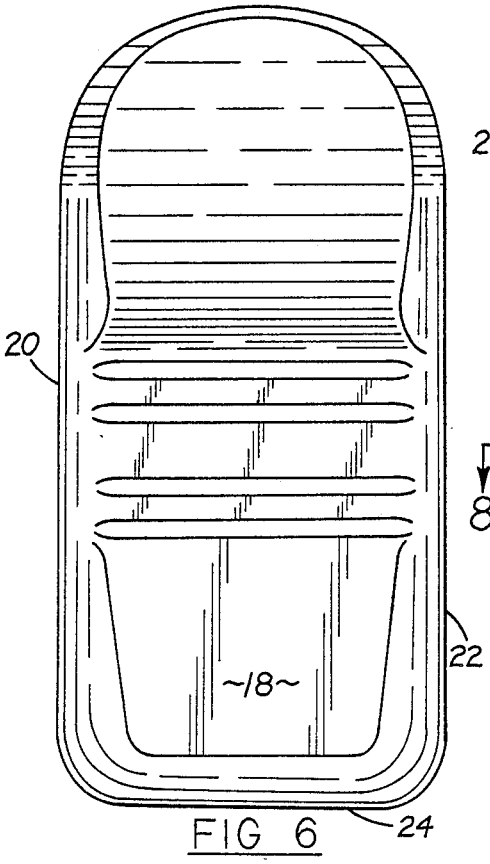
Figure 7:
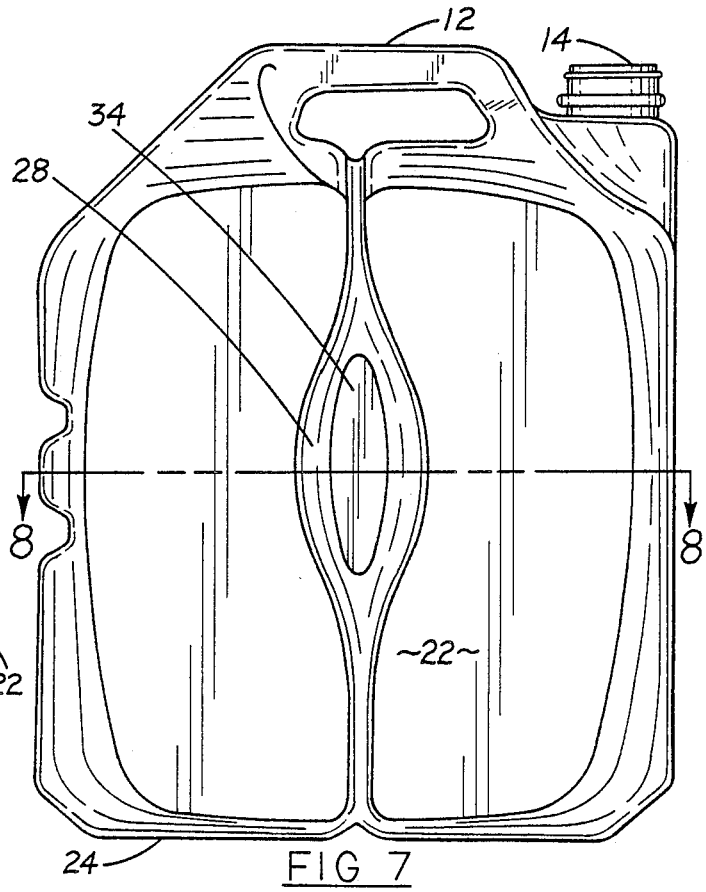

In FIGS. 1 through 7 the bottle comprises a top 10 having a handle 12 and spout 14. The bottle includes ends 16 and 18 and large sides 20 and 22 with a bottom 24. Formed in the large sides 20 and 22 are oblong depressions 26 and 28. The oblong depressions 26 and 28 extend vertically as shown to merge with a circumferential depressed rib 30 which in turn extends over the top 10 and bottom 24 of the bottle.

Figure 8:
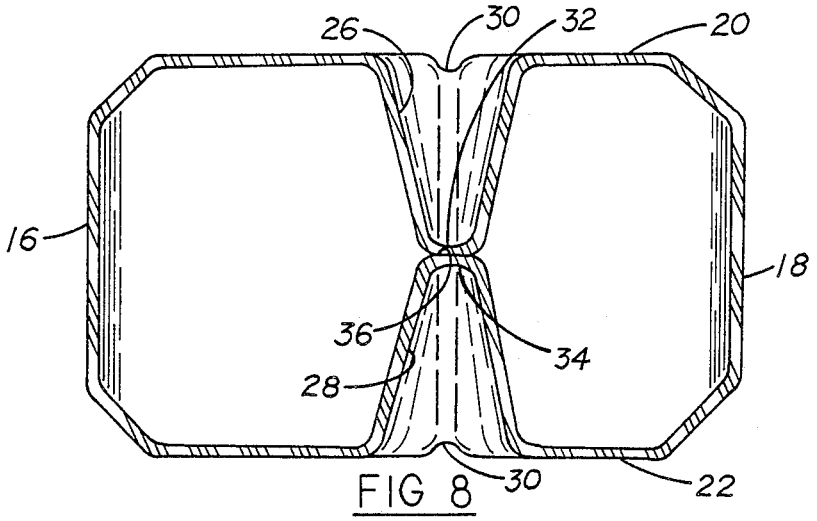
FIG. 8 is a cross-section through the bottle midriff taken along the line 8—8 in FIG. 7.

As best shown in FIG. 8 the oblong depressions 26 and 28 extend to oblong bottoms 32 and 34 in mutual contact 36 at the center of the bottle. In the blow molding process for manufacturing the bottle, the hot soft plastic parison is blown and squeezed by the mold halves of the bottle mold. The oblong bottoms 32 and 34 are squeezed together in tight hot contact 36 to form a bond therebetween that is retained as the bottle is cooled.

The mutually joined oblong depressions 26 and 28 of the present invention provide a surprisingly substantial increase in rigidity to the large sides 20 and 22 of the bottle in comparison to a similar bottle having circular mutually joined depressions and a depressed midriff rib. The latter configuration is shown in applicant's pending design application Ser. No. 06/903,102.

The applicant performed tests to compare the previous design with the circular depressions and the new design with the oblong depressions and major length rib. A 213 gram old design was compared with a 183 gram new design by filling with water and measuring the maximum outward expansion of the sidewall. The bottles are of approximately the same size, however, the new bottle has a thinner sidewall resulting in the lower weight. The sidewall expansion of the old bottle was 0.54 inches in comparison with a sidewall expansion of 0.46 inches for the new bottle. Thus, despite a reduction in weight of about 14% the new design resulted in a reduction of about 15% in expansion or distortion of the sidewall. Such a reduction in both weight and distortion simultaneously is unexpected and provides a substantial improvement in material cost over the large production run for a bottle in a highly competitive industry.

I claim:

1. A thin-walled substantially parallelepiped bottle having two opposed sides, a top, a bottom, and two ends, the top, bottom and ends each of less area than each side, oblong depressions having major and minor axes in the opposed sides, said oblong depressions extending inwardly being joined together, and a circumferential depressed rib extending about the bottle generally in the direction of the largest dimension of the opposed sides to join the oblong depressions into a continuous rib about the bottle, said rib joining the oblong depressions along the major axes of the depressions.

2. The thin-walled bottle of claim 1 wherein the depressed rib extends vertically over the top and bottom of the bottle, the major axes of the oblong depressions being oriented vertically.

3. The thin-walled bottle of claim 1 wherein the opposed sides are generally rectangular.

4. The thin-walled bottle of claim 1 wherein the oblong depressions include oblong and flat bottoms, the joinder therebetween being at the center of the bottle.

5. The thin-walled bottle of claim 1 wherein the bottle includes a handle formed above the top, said rib extending from side to side in the top beneath the handle.

6. A thin-walled substantially parallelepiped bottle having two opposed sides, a top, a bottom and two ends, the top, bottom and ends each of less area than each side, depressions in the opposed sides, said depressions extending inwardly into mutual contact therebetween, the improvement wherein said depressions are of oblong shape merging with a circumferential rib that extends about the bottle from the major axes of the oblong depressions, said rib generally extending in the direction of the largest dimension of the opposed sides.

7. The thin-walled bottle of claim 6 wherein the rib extends vertically over the top and bottom of the bottle, the major axes of the oblong depressions being oriented vertically.

8. The thin-walled bottle of claim 6 wherein the opposed sides are generally rectangular.

9. The thin-walled bottle of claim 6 wherein the mutual contact between the oblong depressions is oblong and flat.

10. The thin-walled bottle of claim 6 wherein the mutual contact between the oblong depressions is at the center of the bottle.

11. The thin-walled bottle of claim 6 wherein the bottle includes a handle formed above the top, said rib extending from side to side in the top beneath the handle.

* * * * *